US005088801A

United States Patent [19]

Rorke et al.

[11] Patent Number: 5,088,801

[45] Date of Patent: Feb. 18, 1992

[54] FILE HOLDERS AND BRIEFCASE THEREFOR

[75] Inventors: A. Brooks Rorke, Fairfield, Conn.; Wallace C. Bullwinkle, Norristown, Pa.

[73] Assignee: Westinghouse Electric Corp., Pittsburgh, Pa.

[21] Appl. No.: 536,871

[22] Filed: Jun. 12, 1990

[51] Int. Cl.[5] ..... A47B 63/00

[52] U.S. Cl. ..... 312/184; 312/244

[58] Field of Search ..... 312/244, 184; 220/23, 220/86, 94 A; 206/557, 514

[56] References Cited

U.S. PATENT DOCUMENTS

| | | | |
|---|---|---|---|
| 370,244 | 9/1887 | Cline et al. . | |
| 3,005,572 | 10/1961 | Gustafson et al. | 220/94 A |
| 3,220,625 | 11/1965 | Protheroe . | |
| 3,363,954 | 1/1968 | Brungardt et al. . | |
| 3,550,979 | 12/1970 | Protzmann . | |
| 3,815,800 | 6/1974 | Monahan . | |
| 3,938,870 | 2/1976 | Guest et al. . | |
| 4,012,087 | 3/1977 | Edwards, Jr. . | |
| 4,024,590 | 5/1977 | Wendt | 220/94 A X |
| 4,033,461 | 7/1977 | Nevai | 206/557 X |
| 4,226,328 | 10/1980 | Beddow | 206/514 X |
| 4,290,658 | 9/1981 | DeRosa . | |
| 4,512,480 | 4/1985 | Evenson . | |
| 4,527,677 | 7/1985 | March et al. . | |
| 4,717,215 | 1/1988 | Everts . | |
| 4,811,769 | 3/1989 | Phares . | |
| 4,820,001 | 4/1989 | Paul . | |

FOREIGN PATENT DOCUMENTS 914081 12/1962 United Kingdom .

*Primary Examiner*—Joseph Falk

[57] ABSTRACT

An integrated system for storing and transporting files, flat materials, and office supplies is disclosed, including a file cabinet having bottomless drawers for receiving hanging file and supply holders, a briefcase having inward-facing ledges for receiving hanging holders, and a portable, unitary file holder compatible with standard letter and legal-size hanging file drawers. The file holder includes twin handles for grasping and carrying the file holder, a hanging file rail disposed within the file holder for supporting standard letter-size files, non-slip feet for placing the unitary file holder on any suitable surface, a plurality of divider panels and a file holder bottom portion disposed to receive such panels. A briefcase is provided and is adapted to receive such file holders by hanging and supporting them using means similar to a standard hanging file drawer. According to one embodiment of the present invention, a file holder is provided which is molded of a relatively rigid thermoplastic material. The supply holder hangs transversely in a file drawer and accepts panels for subdividing the holder in small compartments. The briefcase receives hanging file holders and folders on plural interior ledges disposed at a distance substantially equivalent to the distance between hanging rails in a standard hanging file drawer.

31 Claims, 7 Drawing Sheets

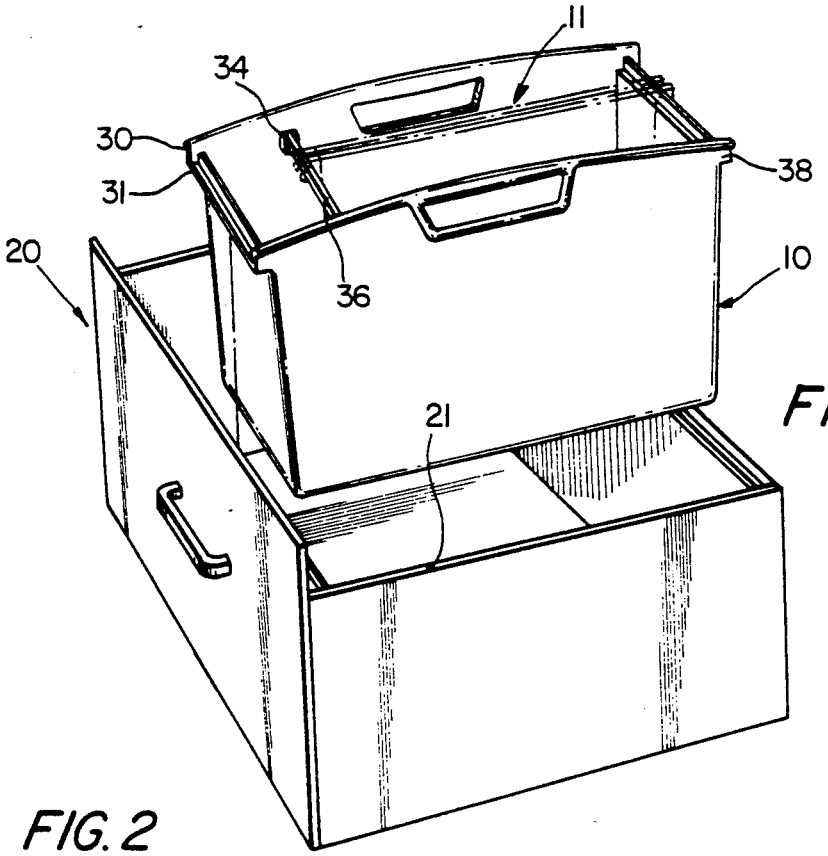
FIG. 1
FIG. 2
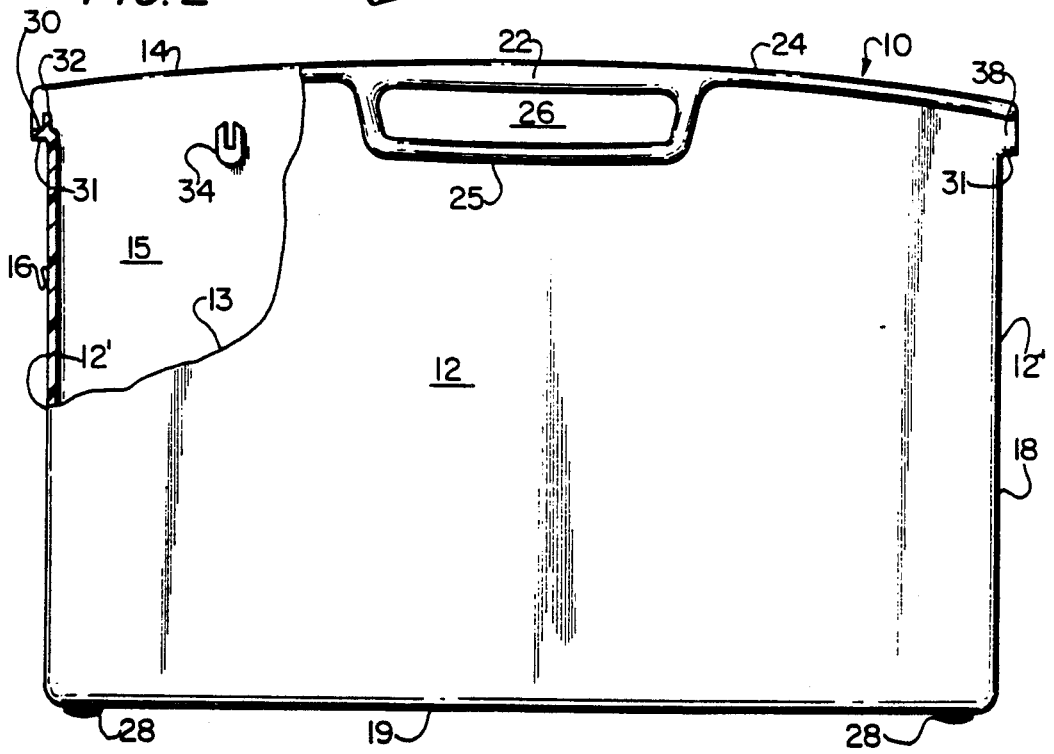

FILE HOLDERS AND BRIEFCASE THEREFOR

FIELD OF THE INVENTION

The present invention generally relates to office supplies for organizing and transporting groups of files or file folders. The present invention specifically relates to portable holding and carrying apparatus for transporting plural files in an organized fashion, and further relates specifically to briefcases adapted to receive such transporting and holding apparatus.

BACKGROUND OF THE INVENTION

Organizing and accessing large volumes of files is a significant problem in the office environment. Frequently, a particular project will require access to large numbers of files containing many sheets of paper. Typically, these files are organized in manila file folders placed upright in lateral stacks within file cabinets having multiple drawers. Such manila folders are relatively slippery; a stack of such folders, when carried from place to place, is easily dislodged or dropped. The threat of files slipping apart creates a likelihood that papers within the files may be dropped, misplaced, disordered, or lost.

Further, frequent travel is common for office workers and executives. Business travel often requires transporting large numbers of files for use at a remote site. Until development of the present invention, most business travelers have simply removed files one-by-one from file drawers, placed them in an ordinary briefcase, and moved the entire case to the remote site. However, this technique is not convenient when business travel requires transportation of flat material not suited to storage in file folders. For example, books, magazines, video tapes, or other physical objects associated with a particular business project are not conveniently stored in file folders. Transporting such objects and files associated with them is awkward using prior art devices.

For example, U.S. Pat. No. 370,244 (Cline et al) shows a book holder and cover designed to facilitate carrying books or files. However, the Cline device is not intended for use in conjunction with a standard file cabinet.

Similarly, U.S. Pat. No. 3,220,625 (Protheroe) shows a tote box which is slidably received by desk drawer slides secured below a desktop. However, the Protheroe device is not adapted for use with a briefcase or standard file drawers.

U.S. Pat. No. 4,527,677 (March et al) discloses a carrying case having a removable divider assembly which may be used to transport divided flat material. However, the divider is not adapted for use with a standard file drawer.

U.S. Pat. No. 4,811,769 (Phares) describes an insert for retaining different articles; the insert is adapted for placement into a purse. However, the insert is not adapted to accept hanging file folders, and is not constructed to hang in a standard file drawer.

Other prior inventors have attempted to create devices capable of organizing files within a standard file drawer. For example, U.S. Pat. No. 4,820,001 (Paul) shows a file drawer divider system including rectangular corrugated cardboard dividers. The dividers are placed in file drawers to retain the files in an upright state. However, the dividers and files associated with them are not simultaneously removable from the file drawer, and the dividers are not adapted to hang in a conventional file drawer.

Thus, the prior art is deficient and does not include a device having all the features of the present invention. Specifically, the prior art does not include a file storage and transporting device adapted to be received by standard file drawers equipped for hanging file holders, and capable of rapid and easy removal from the file drawer and placement in a briefcase adapted for transporting files. Accordingly, business persons, travelers, and others would find it useful and desirable to have a combined briefcase and file holder for use with standard files having the features and characteristics of the present invention.

SUMMARY OF THE INVENTION

Accordingly, it is one object of the present invention to provide improved means for grouping, organizing, and transporting files and associated materials.

Another object of the present invention is to provide a file holder capable of hanging in standard hanging file drawers.

A further object of the present invention is to provide an improved file holder adapted for insertion into a briefcase for transporting files and associated materials A further object of the present invention to provide a combined file holder and briefcase which are simple in construction and easy to use.

Still a further object of the present invention is to provide a transportable file holder compatible with standard file drawers having plural compartments for organizing and neatly storing diverse articles such as pens, pencils, papers of odd sizes, and other related supplies.

The foregoing objects, and other objects which will become apparent from the following discussion, are achieved by providing a portable, unitary file holder compatible with standard letter and legal-size hanging file drawers, having twin handles for grasping and carrying the file holder, a hanging file rail disposed within the file holder for supporting standard letter-size files, non-slip feet for placing the unitary file holder on any suitable surface, a plurality of divider panels and a file holder bottom portion disposed to receive such panels, and a briefcase adapted to receive such file holders by hanging and supporting them using means similar to a standard hanging file drawer.

According to one embodiment of the present invention, a file holder is provided which is molded of a relatively rigid thermoplastic material.

BRIEF DESCRIPTION OF THE DRAWINGS

FIG. 1 is a perspective view of a first embodiment of a file holder according to the present invention shown elevated above a standard lateral file drawer.

FIG. 2 is a side elevation of a first embodiment of a file holder according to the present invention.

DETAILED DESCRIPTION OF THE PREFERRED EMBODIMENTS

Figure 3:
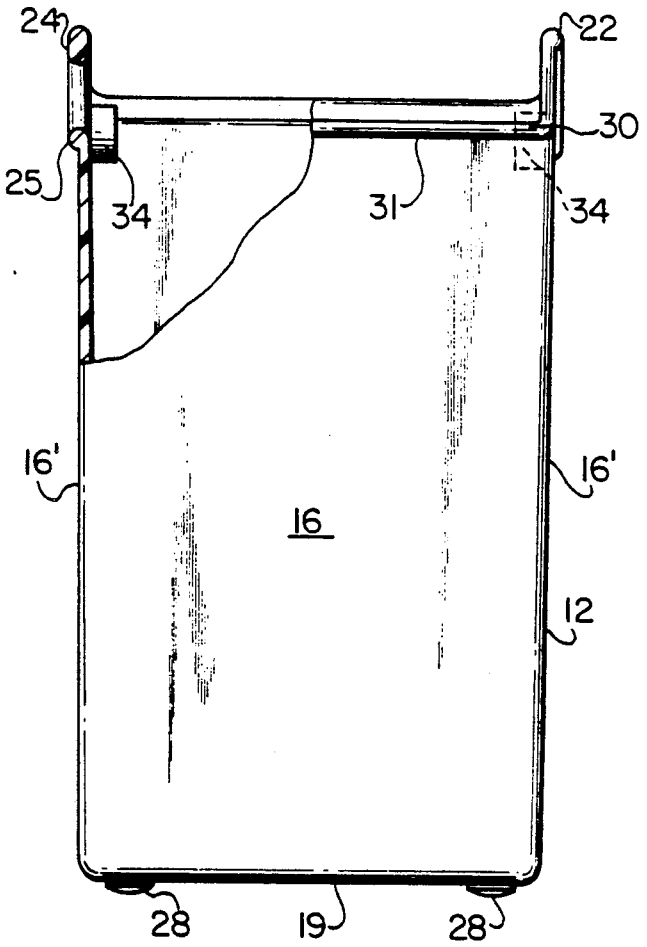
FIG. 3 is an end elevation of a first embodiment of a file holder according to the present invention.

In the following detailed description of the preferred embodiments, specific terminology is used for the sake of clarity. However, it should be understood that the specific terms so selected include each and every technically equivalent term by which the invention and its components may be duplicated in substantially the same manner to accomplish substantially the same purpose.

Referring now to FIGS. 1 through 4, a first embodiment of a file holder according to the present invention, and a briefcase therefor, is shown; the file holder is generally designated using reference numeral 10 and is made of a suitable material such as plastic. As particularly shown in FIGS. 2 and 3, the file holder 10 includes two side walls 12 and 14 which are constructed as mirror-image reflections of one another. Side walls 12 and 14 each include vertical end edges 12' and 14', respectively, which define the ends of walls 12 and 14. The file holder 10 further includes end walls 16 and 18, which are secured to edges 12' and 14' of side walls 12 and 14. As shown in FIG. 1, the file holder 10 including walls 12, 14, 16, and 18 generally resembles a rectangular box having one open end 11. The bottom floor 19 of the file holder 10 is a generally planar, rectangular wall joined perpendicularly to the lower edges of vertical walls 12, 14, 16, and 18 to define a floor for the file holder.

Walls 12 and 14 are constructed having a generally trapezoidal shape such that their top and bottom edges are generally parallel and side edges 12' and 14' are angularly canted inwardly. As shown in FIGS. 2 and 3, edges 12' and 14' of walls 12 and 14 are outwardly canted at an angle of approximately 1 degree from the vertical. Further, walls 16 and 18 are angled inwardly so that floor 19 has smaller overall peripheral dimensions than open end 11. This provides additional clearance space and permits a file holder 10 to be easily inserted into a narrow, standard file drawer and easily removed.

A file holder 10 according to the present invention further includes an outwardly extending hanger lip 30 emanating from the top edge of end walls 16 and 18. The hanger lip 30 extends across the entire width of walls 16 and 18; as shown in FIGS. 1 and 2, the top corners of walls 12 and 14 are provided with laterally extending arms 38 which arms 38 extend over and cover the ends of hanger lip 30 at the point at which the lips 30 intersect with the wall 12 and 14. The upper interior surface of hanger lip 30 includes a vertically-oriented file rib 32 which provides support for standard hanging file folders. The rib 32 is constructed substantially in alignment with the top edge of walls 16 and 32, such that downward force exerted by placing file folders on rib 32 is directed to, and absorbed by, walls 16 and 18.

Hanger lip 30 is further provided with a bottom exterior surface 31. As particularly shown in FIG. 1, when a file holder 10 according to the present invention is placed into a standard hanging file drawer, surface 31 rests directly upon the hanging frame 21 of the drawer 20. Thus, the hanger lip 30 and its bottom surface 31 "hang" on the frame 21 of the drawer 20 in the same manner as a standard hanging file folder; a file holder 10 according to the present invention is specifically constructed to be compatible with such hanging file drawers.

As specifically shown in the partial cut away portion of FIG. 2, walls 12 and 14 are provided with hanging folder hanger brackets 34, which brackets 34 are formed on interior surfaces 13 and 15, respectively, of walls 12 and 14. Brackets 34 resemble an inverted U-shaped notch, and are adapted to receive a hanging file folder hanger bar 36, as shown in FIG. 1. The brackets 34 are secured to surfaces 13 and 15 at a point enabling a hanger bar 36 to receive the hanging hooks of standard letter-sized hanging file folders, shown in phantom form in FIG. 1.

In one embodiment of the present invention, walls 12 and 14 are each provided with unitary molded handles generally designated 22. Handles 22 comprise an upper molded bead 24 and a lower bead 25 which together define an oblong finger grip space 26. Bead 25 is generally horizontal and is disposed such that the top edge of file folders hanging within the file holder 10 do not protrude above a plane level with beads 25. Thus, bead 25 and space 26 are disposed to provide finger clearance above the tops of file folders placed in the file holder 10.

As further shown in FIGS. 2 and 3, a first embodiment of a file holder 10 according to the present invention further includes plural molded supporting feet 28; in a preferred embodiment, a molded foot 28 is provided at each corner on the exterior underside of floor 29. The feet 28 support the file holder 10 and prevent marring or scraping of a surface onto which the file holder 10 is placed.

Figure 4:
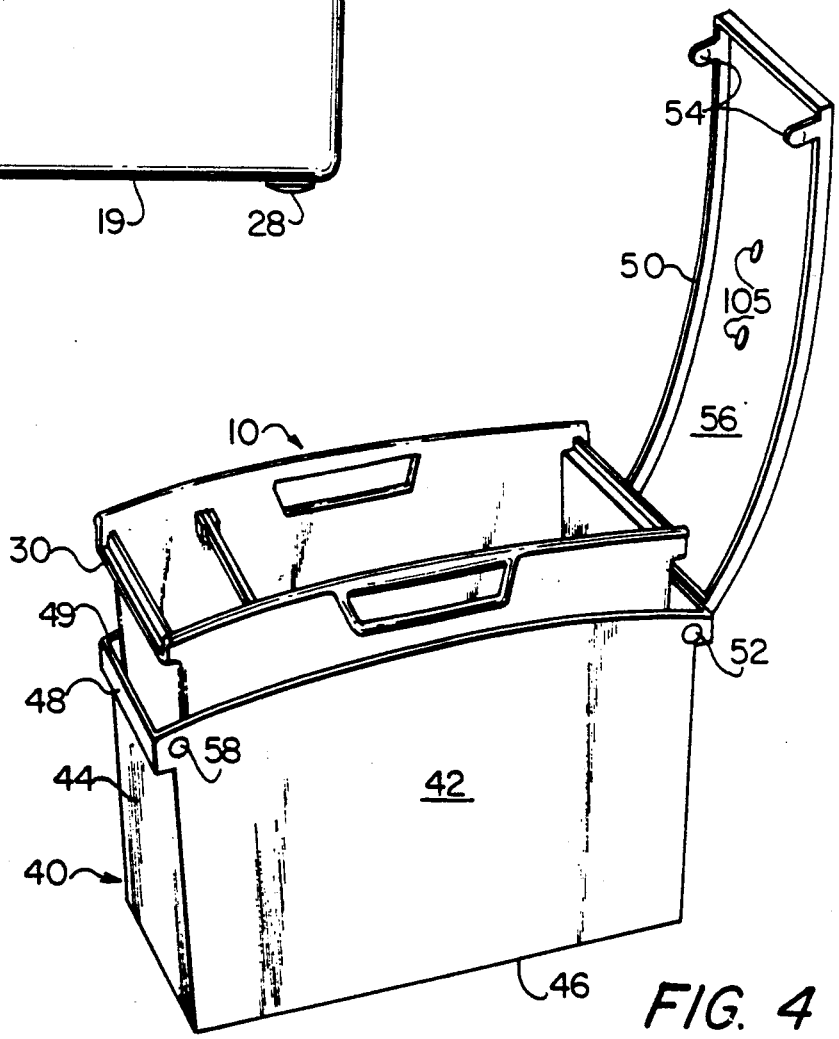
FIG. 4 is a perspective view of a first embodiment of a file holder according to the present invention shown partially nested within a briefcase designed to receive the file holder.

FIG. 4 depicts a briefcase specially adapted to receive a file holder 10 according to the present invention. The briefcase, which is generally designated using reference numeral 40, and as oriented in FIG. 4, includes two identical front and rear walls 42 secured at generally right angles to identical end walls 44. A generally rectangular shaped bottom wall or floor 46 is secured to the lower edges of walls 40 and 42, such that the combined walls 42, 44, and 46 form an open-ended box.

Briefcase 40 is further provided with a hinged lid 50 secured to one end of the briefcase 40 using a conventional hinge 52. Two downwardly projecting latches 54 are secured to the interior surface 56 of the lid 50. The latches 54 are secured to lid 50 at the opposite end of lid 50 from hinge 52. Further, the latches 54 engage two retaining buttons 58 provided at one end of the briefcase body 40. The retaining buttons 58 are spring-loaded and extend through walls 42 of the briefcase to engage the closures 54 when the lid 50 is closed upon briefcase 40.

The briefcase 40 is further provided with a retaining ledge 49 extending outwardly from walls 44. A short vertical wall 48 provides a cover for the ledge 49 while permitting adequate clearance space for a file holder 10 inserted in the briefcase 40. In operation, when a file holder 10 is placed in the briefcase, the bottom surface 31 of the hanger lips 30 of the file holder 10 rest directly on ledge 49 of the briefcase 40. Thus, a file holder 10 "hangs" within the briefcase 40 in a manner identical to that employed by standard hanging file folders.

Figure 10:
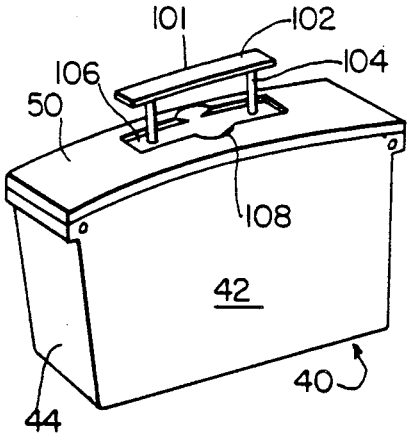
FIG. 10 is a perspective view of the briefcase of FIG. 4 showing details of the handle structure.

As depicted in FIG. 10, the briefcase 40 is provided with a handle generally designated using reference numeral 100. The handle 100 comprises a relatively flat, elongated grasping arm 102 secured at right angles to upright legs 104. Lid 50 is provided with apertures 105 which receive legs 104. The interior bottom end of legs 104 is provided with a retaining button 105 having a larger diameter than legs 104. Thus, when handle 100 is pulled upward by grasping arm 102, the buttons 105 are pulled flush against the interior surface of lid 50, permitting the case to be lifted by the handle. Further, a recessed area 106 having exterior peripheral dimensions substantially equal to the peripheral dimensions of grasping arm 102 is provided. When handle 100 is pushed into the briefcase 40, the grasping arm 102 nests within recess 106. A finger clearance space 108 is provided to enable arm 102 to be grasped when it is recessed within lid 50.

Figure 11:
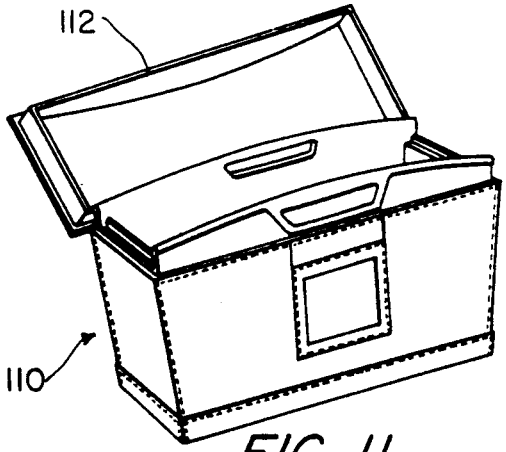
FIG. 11 is a perspective view of a file holder according to the present invention nested within a second embodiment of a briefcase designed to receive the file holder.
Figure 12:
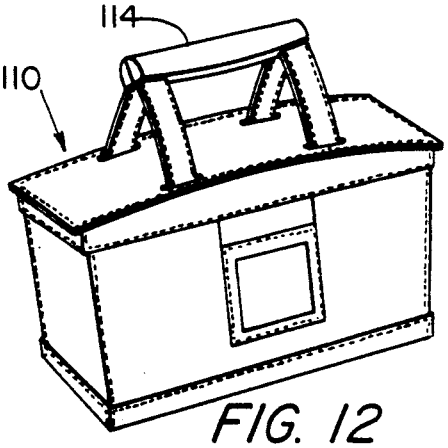
FIG. 12 is a perspective view of the briefcase of FIG. 11 showing the handle structure.

FIGS. 11 and 12 illustrate an alternative embodiment of a briefcase 110 for holding file holders according to the present invention. The embodiment of FIGS. 11 and 12 is constructed of pliable material such as sewn leather and includes a hinged lid 112 and a handle 114 secured to the top of lid 112.

Thus, when the file holders 10 and 60 of the present invention are used in combination with briefcases 40 or 110, an integrated system for organizing, supporting, and transporting files and related materials is provided. A businessperson or office worker using this system may place files and associated materials in a file holder 10 or a supply holder 60 and store the holders 10 or 60 in a standard desk drawer. When business travel requires transporting the files and materials, the holders 10 or 60 are removed from the desk drawer and placed in a briefcase 40 or 110, permitting effective and rapid transportation of organized files and materials.

FIGS. 5 through 9 illustrate a second embodiment of a hanging holder according to the present invention. The embodiment of FIGS. 5 through 9 is adapted to receive office supplies and related items, such as pencils, pens, spools of tape, scissors, computer diskettes and like items.

As particularly shown in FIGS. 6 through 9, a second embodiment of the present invention comprises a supply holder generally designated with reference numeral 60 and made of a suitable material such as plastic. The supply holder 60 includes symmetrically identical front and rear walls 62 and 64 each having a bottom edge 62' and two end edges 63'. A generally rectangular bottom wall or floor 70 is secured to the bottom edges 62' of walls 62 and 64. Two symmetrically identical end walls 66 and 68 are secured to the end edges 63' of walls 62 and 64, such that assembled walls 62, 64, 66, 68, and 70 form a generally rectangular box having an open top.

Figure 6:
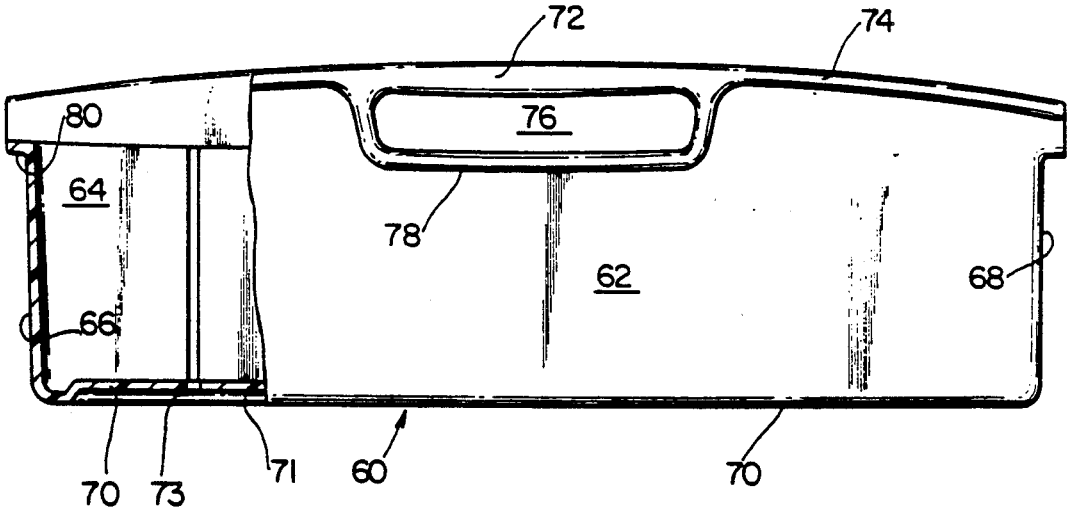
FIG. 6 is a side elevation of a second embodiment of a file holder according to the present invention.

FIG. 6 shows the specific structure of identical side walls 62 and 64. Both walls 62 and 64 are provided with symmetrically identical gripping handles generally designated with reference numeral 72. A top bead 74 running the length of walls 62 and 64 defines the top of handles 72, and a bottom bead 78 defines the bottom of handle 72. Space 76 provides finger clearance for persons gripping handles 72.

Figure 5:
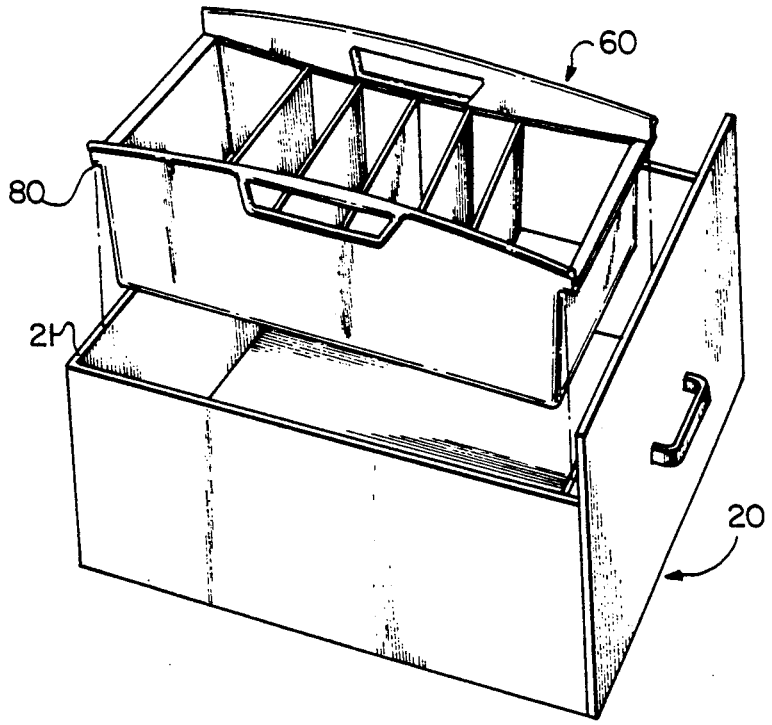
FIG. 5 is a perspective view of a second embodiment of a file holder according to the present invention shown elevated above a standard letter-size file drawer.
Figure 7:
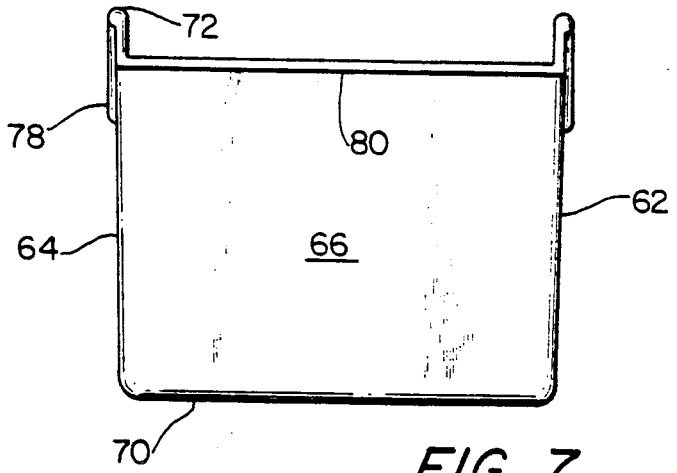
FIG. 7 is an end elevation of a second embodiment of a file holder according to the present invention.

As shown in FIGS. 5, 6, and 7, end walls 66 and 68 are further provided with an outwardly extending hanging ledge 80. The ledge 80 is adapted to enable a supply holder 60 to hang when placed longitudinally in a standard file drawer 20, as shown in FIG. 5. When the supply holder 60 is placed in the drawer, ledge 80 rests directly on the upper edges 21 of the drawer frame.

Figure 8:
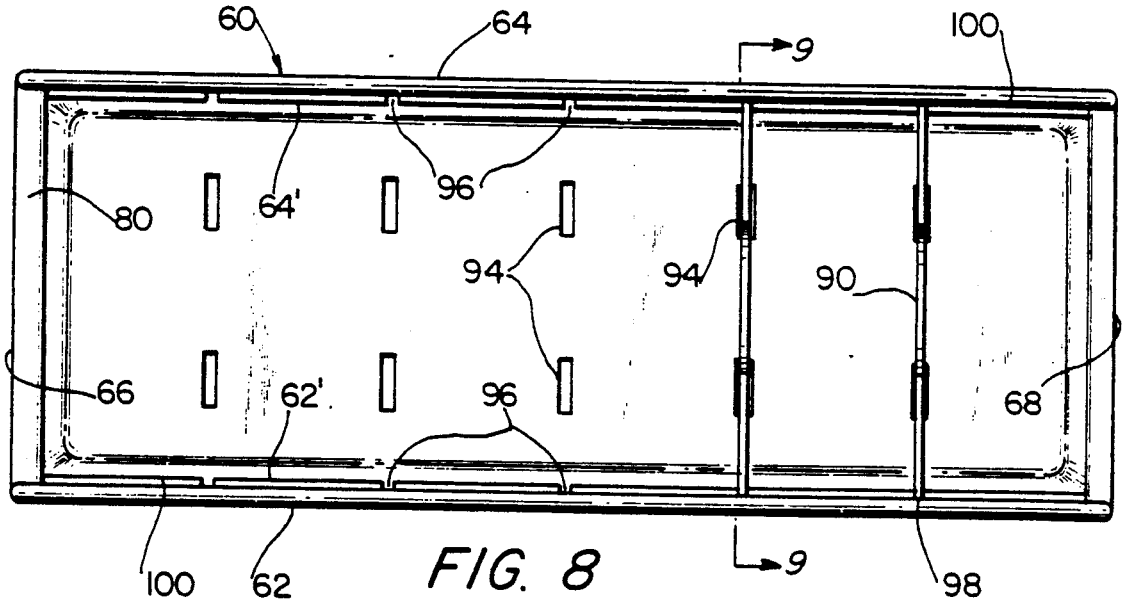
FIG. 8 is a top plan view of the file holder of FIGS. 6 and 7.
Figure 9:
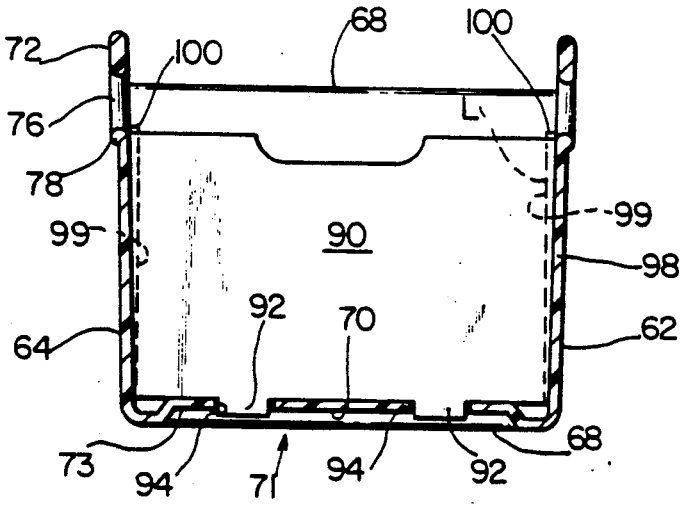
FIG. 9 is a lateral sectional view of the file holder of FIGS. 6, 7, 8 taken at line 9—9 of FIG. 8.

As illustrated in FIGS. 6 and 9, the exterior surface 73 of bottom wall 70 of the supply holder 60 is recessed, providing bottom clearance space 71. As further shown in FIG. 8, the bottom wall 70 includes plural notch holes 94; walls 62 and 64, respectively, include interior surfaces 62' and 64' which are provided with slots 96. Notches 94 and slots 96 are provided to permit the supply holder 60 to receive and retain plural divider panels 90. As shown in FIG. 9, divider panels 90 are provided having downwardly extending tabs 92. Preferably, two parallel rows of rectangular notches 94 are provided in the bottom wall 70. The slots 94 are aligned in pairs which pairs are further aligned with notches 96. As shown in FIG. 8, a panel 90 inserted in the supply holder 60 engages one pair of slots 94 and one opposite pair of notches 96. The combination of notches 96 and slots 94 securely retains the panel 90 vertically and perpendicular to floor 70. Thus, in operation, when a divider panel 90 is placed in the supply holder 60, downwardly extending tabs 92 engage and are received by notches 94. Slots 96 provide clearance space to receive the end edges 98 of divider panels 90. Plural divider panels 90 may be added or removed as desired by the user of a supply holder 60.

As shown in FIGS. 8 and 9, slots 96 are angularly disposed within interior walls 100 which are secured to walls 62 and 64. As specifically shown in FIG. 9, interior walls 100 are constructed having a tapered profile such that their thickness decreases toward the bottom of the supply holder 70. The phantom line L of FIG. 9 is vertical and perpendicular to floor 70. Thus, a divider panel 90 placed in the supply holder 70 is retained in place by engagement of tabs 92 with holes 94, and by engagement of edges 98 with slots 96. Plural divider panels 90 may be added or removed as desired by the user of a supply holder 70.

Figure 13:
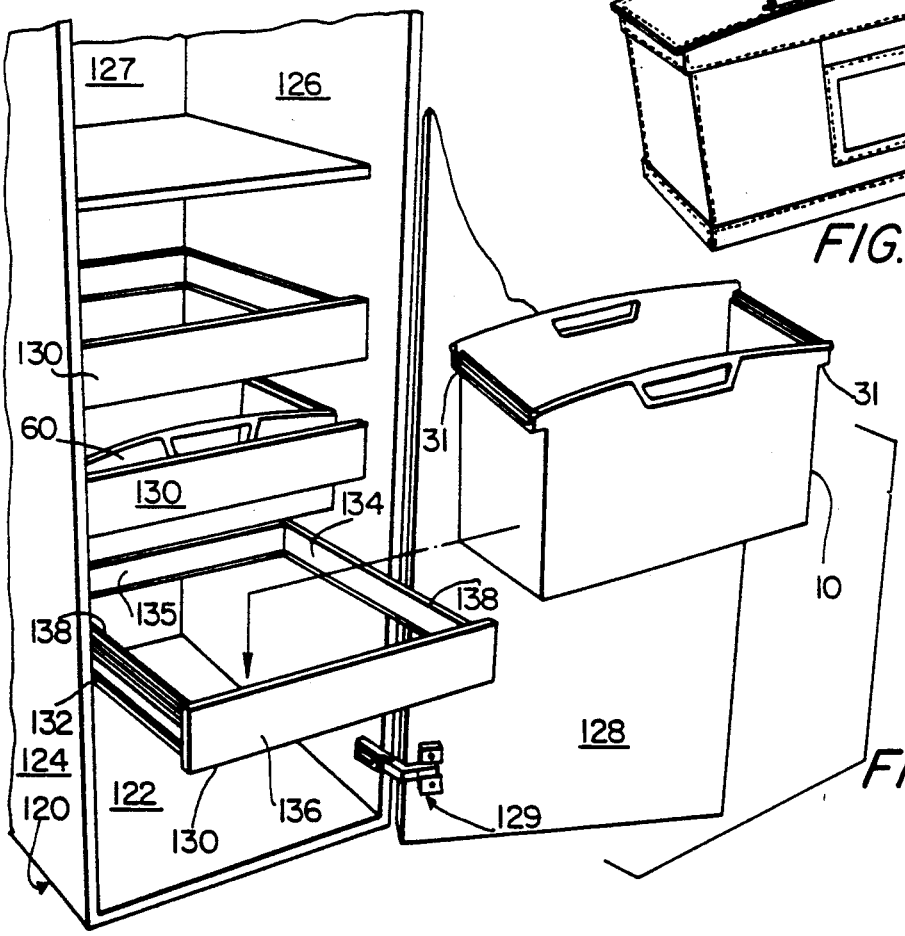
FIG. 13 is a perspective view of a cabinet having open-bottom drawers adapted to receive file holders according to the present invention.

FIG. 13 illustrates an upright file cabinet 120 having a plurality of drawers 130 adapted to receive hanging file holders 10 according to the present invention. The cabinet 120 comprises a substantially rectangular floor 122, identical side walls 124 and 126, and rear wall 127. The bottom edges of walls 124, 126, and 127 are joined at right angles to the perimeter edges of floor 122, such that in combination the walls 124, 126, and 127 and floor 122 form an open upright cabinet. A hinged front door 128 is provided and is secured to wall 126 using conventional hinges 129.

The interior of cabinet 120 is provided with a plurality of drawers 130. Each drawer 130 comprises a left arm 132, a right arm 134, a rear panel 135, and a front panel 136. Conventional drawer slides are secured to the outward-facing surfaces of arms 132 and 134, and the slides are slidably received by the interior surfaces of walls 124 and 126, such that the drawers 130 operate as conventional sliding drawers. The drawers 130 do not include a bottom floor.

Arms 132 and 134 are each further provided with top surfaces 138. When a file holder 10 or a supply holder 60 is placed into a drawer 130, the bottom ledge surface 31 of file holders 10 rests upon surface 138. Thus, a file holder 10 or a supply holder 60 "hangs" on surfaces 138 of the arms 132 and 134 in a manner identical to that by which conventional hanging folders hang in a file drawer.

Cabinet 120 may be provided with a plurality of drawers 130 spaced at different vertical distances from one another. Thus, the different distances separating the drawers 130 accommodate the different heights of the relatively short supply holder 60 and the taller file holder 10 according to the present invention.

In combination, the cabinet 120, the drawers 130, and the file holder 10 or supply holder 60 form an integrated system for storing and transporting files and associated materials. Specifically, an office worker or executive may place files and other material into a file holder 10 or a supply holder 60 which may be conveniently stored by hanging it in a drawer 130 of the cabinet 120 shown in FIG. 13. When the contents of a file holder 10 or a supply holder 60 must be transported to another location, the entire holder 10 or 60 may be removed from the drawer 130 and easily carried to the remote location. Thus, the present invention obviates inconvenient and disorderly removal of files and materials from file drawers and transporting them loose to another place. Instead, all materials are neatly organized in a holder 10 or a holder 60 according to the present invention.

Figure 14:
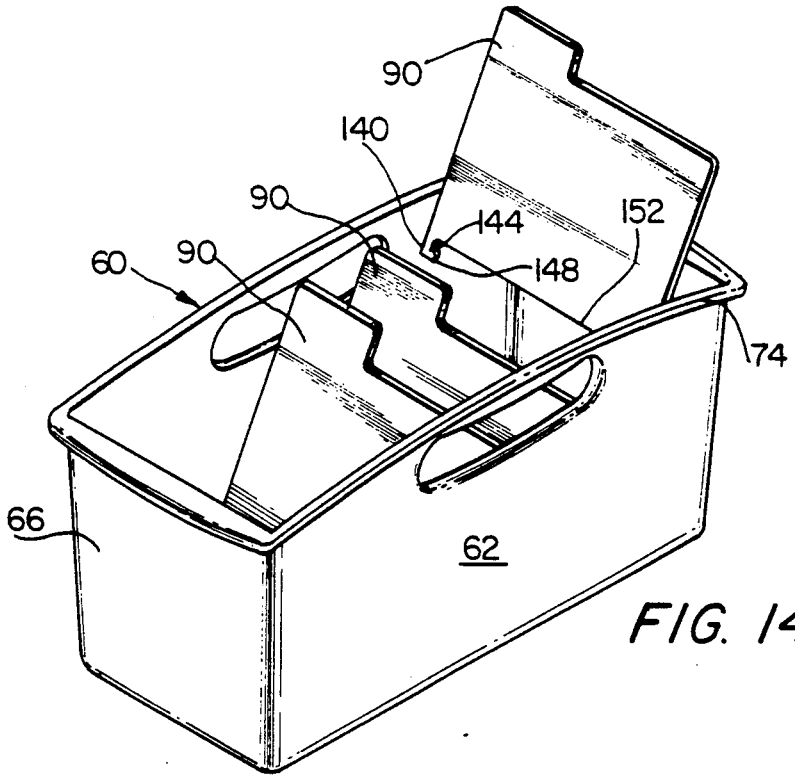
FIG. 14 is a perspective view of a third embodiment of a file holder according to the present invention.
Figure 15:
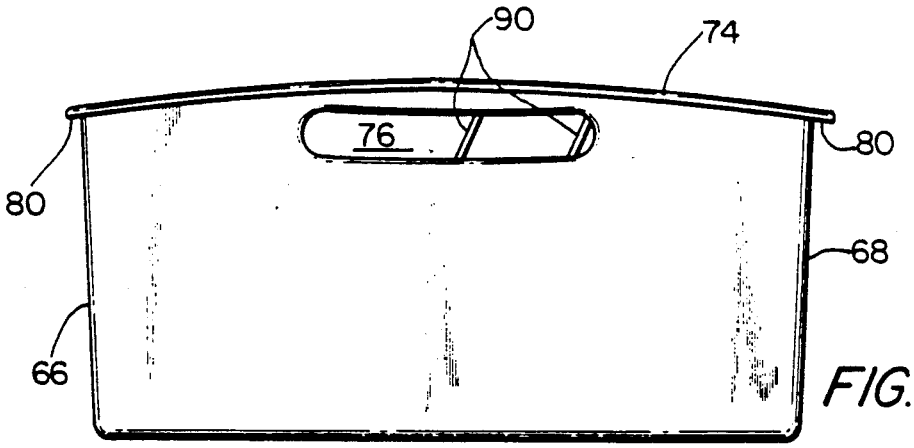
FIG. 15 is a side elevation view of the embodiment of FIG. 14.
Figure 16:
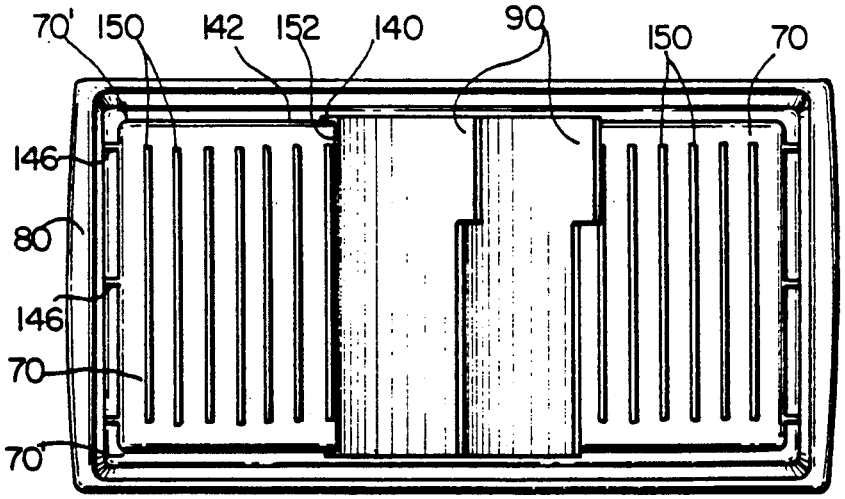
FIG. 16 is a top plan view of the embodiment of FIGS. 14 through 15.

Many modifications and variations of the present invention are possible in light of the above teachings and specification. For example, the holder 20 of FIGS. 5 through 9 may be constructed in another embodiment as shown in FIGS. 14 through 16. In the embodiment of FIGS. 14 through 16, the holder 60 is provided with plural, angularly-oriented divider panels 90, each provided with a pair of spaced-apart hooklike tabs 140 for retaining the panels 90 in place within the holder 60. The floor arrangement of the holder 60, shown in FIG. 16, includes a relatively planer, rectangular floor 70, suspended above a lower subfloor 70' using plural sprues 146, thereby creating a perimeter channel 142 around floor 70. The inward-facing mouths 144 of tabs 140 engage the outer edges of floor 70, such that the bottom portion 148 of the hooks 140 protrudes into channel 142. This arrangement enables the mouth 144 of the tabs 140 to securely grip the outer edge of floor 70 and thereby retain the panel 90 in place. The floor 70 is further provided with plural, parallel, spaced-apart elongated ridges 150 which provide a stop against which the base edge 152 of a panel 90 may seat. Thus, the ridges 150 permit the panels 90 to be retained in place between a pair of the ridges 150, while simultaneously enabling the panel 9 to easily be moved to another position.

Figure 17:
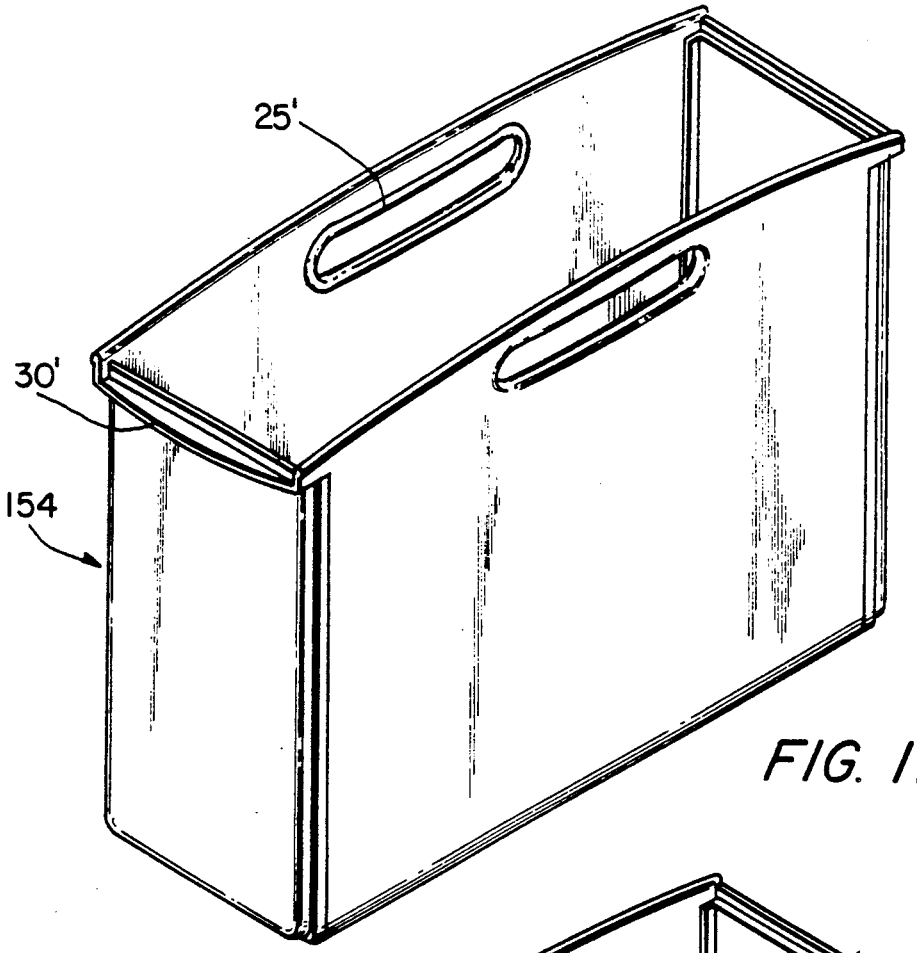
FIG. 17 is a fourth embodiment of a file holder according to the present invention.
Figure 18:
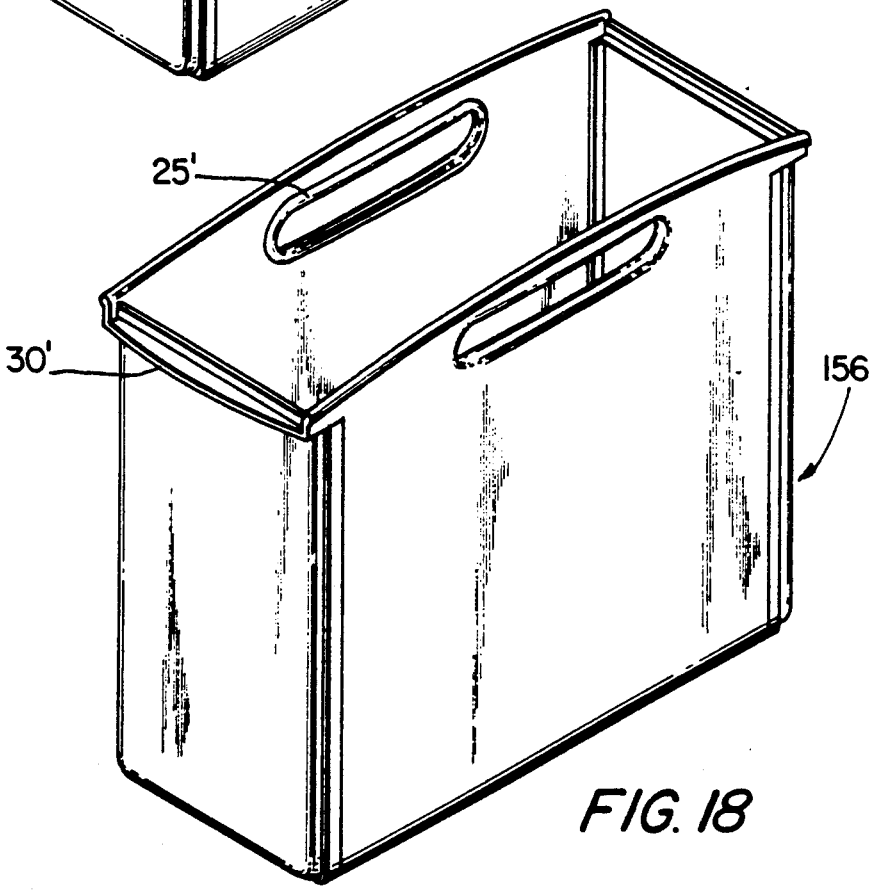
FIG. 18 is a perspective view of a fifth embodiment of a file holder according to the present invention.

Further, the file holder 10 of the present invention may be constructed in several alternative embodiments, including the legal-paper size file holder 154 of FIG. 17, and the letter-size file holder 156 of FIG. 18. The alternative embodiments may also omit the handle bead 25 of FIG. 2; the handle bead 25 may also alternatively appear in the position designated 25' in FIGS. 17 and 18. The hanger lip 30 of the embodiment illustrated in FIGS. 1 and 2 may similarly assume a slightly outwardly-curved shape as shown by lip 30' of FIGS. 17 and 18. It is therefore to be understood that, within the scope of the appended claims, the invention may be practiced otherwise than as specifically described.

What is claimed is:

1. A hanging holder removably hangingly received by a drawer, the drawer including a front panel, two parallel side walls spaced a predetermined distance D from each other and secured perpendicular to said front panel, an end panel parallel to said front panel and secured perpendicular to said parallel side walls, said holder comprising:

(a) a box including a rectangular floor, two opposed side walls each having a top edge and each having a bottom edge, said bottom edges being connected to opposed sides of said floor, two opposed end walls separated by a predetermined distance that is less than distance D, said end walls having bottom edges connected to opposed sides of said floor, and an open top; and (b) said side walls each having opposed outwardly extending arms at said top edge and said end walls each having an outwardly extending shoulder at said upper edge, said shoulders each having side edges, said arms having top edges coextensive with said top edges of said side walls and bottom edges coextensive with said side edges of said shoulders, and said arms together with said shoulders defining two ledges extending outwardly respectively from said side wall top edges, said ledges being separated by said distance D, and said ledges each including hanger means for supporting standard hanging file folders.

2. The holder of claim 1, said floor having peripheral dimensions less than the peripheral dimensions of said open top, and wherein said side walls are angularly canted downwardly inward, said side walls being connected to said floor at an obtuse angle.

3. The holder of claim 2, wherein said end walls are angularly canted downwardly inward, said end walls being connected to said floor at an obtuse angle.

4. The holder of claim 1, further including two handles in said side walls.

5. A hanging holder hangingly receivable by a drawer, the drawer including a front panel, two parallel side walls spaced a predetermined distance D from each other and secured perpendicular to said front panel, an end panel parallel to said front panel and secured perpendicular to said parallel side-walls, said holder comprising:

(a) a box including a rectangular floor, two opposed side walls each having a top edge and each having a bottom edge, said bottom edges being connected to opposed sides of said floor, two opposed end walls separated by a predetermined distance that is less than distance D, said end walls having bottom edges connected to opposed sides of said floor, and an open top; and (b) said side walls each having opposed outwardly extending arms at said top edge and said end walls each having an outwardly extending shoulder at said upper edge, said arms together with said shoulders defining two ledges extending outwardly respectively from said side wall top edges, said ledges being separated by said distance D, and said ledges each including hanger means for supporting standard hanging file folders, and said side walls further including two handles therein each comprising a hand clearance hole disposed in one of said side walls.

6. A hanging holder hangingly receivable by a drawer, the drawer including a front panel, two parallel side walls spaced a predetermined distance D from each other and secured perpendicular to said front panel, an end panel parallel to said front panel and secured perpendicular to said parallel side walls, said holder comprising:

(a) a box including a rectangular floor, two opposed side walls each having a top edge and an interior surface and each having a bottom edge, said bottom edges being connected to opposed sides of said floor, two opposed end walls separated by a distance D' which is less than distance D, said end walls having bottom edges connected to opposed sides of said floor, and an open top; and (b) said side walls each having opposed outwardly extending arms adjacent said top edge and said end walls each having an outwardly extending shoulder at said upper edge, said arms together with said shoulders defining two ledges extending outwardly respectively from said side wall top edges, said ledges being separated by said distance D; and (c) hanging file folder support means for supporting standard hanging file folders, said support means comprising two opposed hanger bar support brackets secured to said interior surfaces of said side walls and a hanging file folder hanger bar, said brackets being laterally separated from one of said ledges by a distance D" that is less than said distance D.

7. The holder of claim 6, said floor having peripheral dimensions less than the peripheral dimensions of said open top, and wherein said side walls are angularly canted downwardly inward, said side walls being connected to said floor at an obtuse angle.

8. The holder of claim 7, wherein said end walls are angularly canted downwardly inward, said end walls being connected to said floor at an obtuse angle.

9. The holder of claim 6, further including two handles in said side walls.

10. The holder of claim 6, further including two handles in said side walls each comprising an oblong hand clearance hole disposed in one of said side walls.

11. The holder of claim 1, further including means for retaining divider panels in said holder.

12. The holder of claim 11, said means for retaining divider panels in said holder comprising plural rectangular slots in said floor.

13. The holder of claim 11, said means for retaining divider panels in said holder including:

(a) plural rectangular horizontal slots disposed in said floor; and (b) plural elongated vertical panel notches disposed in said side wall interior surfaces, said notches being aligned opposite said slots.

14. The holder of claim 11, said means for retaining divider panels in said holder comprising plural rectangular slots in said floor in two lengthwise parallel rows.

15. The holder of claim 11, said means for retaining divider panels in said holder comprising:

(a) plural rectangular horizontal slots in said floor in two lengthwise parallel rows comprising plural pairs of said slots; and (b) plural elongated vertical panel notches disposed in said side wall interior surfaces, said notches being aligned with said pairs of said slots.

16. A hanging folder for files comprising:

a rectangular floor;

two opposed side walls having top edges terminating in a bead and bottom edges connected to opposed sides of said floor, and opposed outwardly extending arms at said top edge, said arms having top edges coextensive with said top edges of said side walls and bottom edges opposite said top edges of said arms, said side walls having formed therein opposed handles, each said handle comprising a holes through one of said side walls adjacent said top edge and surrounded by a bead, said bead surrounding said hole being unitary with said bead at said top edge;

two opposed end walls having top edges terminating in an outwardly extending shoulder and bottom edges connected to opposed sides of said floor, said shoulders having side edges coextensive with said bottom edges of said arms; and an open top;

said arms together with said shoulders defining two ledge means extending outwardly respectively from said side wall top edges for hanging said file holder in a receptacle.

17. The holder of claim 16, said file holder being molded of a relatively rigid thermoplastic material, and said side walls, said end walls, and said floor being unitary with each other.

18. The holder of claim 16, said ledges each including hanger means for supporting standard hanging file folders.

19. A hanging holder for files comprising:

a rectangular floor;

two opposed side walls having top edges terminating in a bead and bottom edges connected to opposed sides of said floor, and opposed outwardly extending arms adjacent said top edge, said side walls having interior surfaces and said side walls having formed therein opposed handles, each said handle comprising a holes through one of said side walls adjacent said top edge and surrounded by a bead, said bead surrounding said hole being unitary with said bead at said top edge;

two opposed end walls having top edges terminating in an outwardly extending shoulder and bottom edges connected to opposed sides of said floor; and an open top;

said arms together with said shoulders defining two ledge means extending outwardly respectively from said side wall top edges for hanging said file holder in a receptacle, said ledge means including hanger means for supporting standard hanging file folders, said hanger means comprising two opposed hanger bar support brackets secured to said interior surfaces of said side walls and a hanging file folder hanger bar.

20. A hanging holder for files comprising:

a rectangular floor;

two opposed side walls having top edges terminating in a bead and bottom edges connected to opposed sides of said floor, and opposed outwardly extending arms adjacent said top edge, and said side walls having formed therein opposed handles, each said handle comprising a holes through one of said side walls adjacent said top edge and surrounded by a bead, said bead surrounding said hole being unitary with said bead at said top edge;

two opposed end walls having top edges terminating in an outwardly extending shoulder and bottom edges connected to opposed sides of said floor; and an open top;

said arms together with said shoulders defining two ledge means extending outwardly respectively from said side wall top edges for hanging said file holder in a receptacle, said ledge means including hanger means for supporting standard hanging file folders, and said hanger means comprising ribs extending upwardly from said shoulders.

21. The holder of claim 16, said floor having peripheral dimensions less than the peripheral dimensions of said open top, and wherein said side walls are angularly canted downwardly inward, said side walls being connected to said floor at an obtuse angle.

22. The holder of claim 16, wherein said end walls are angularly canted downwardly inward, said end walls being connected to said floor at an obtuse angle.

23. The holder of claim 16, further including means for retaining divider panels in said holder.

24. The holder of claim 23, said means for retaining divider panels in said holder comprising plural rectangular slots in said floor.

25. The holder of claim 23, said means for retaining divider panels in said holder including:

(a) plural rectangular horizontal slots disposed in said floor; and (b) plural elongated vertical panel notches disposed in said side wall interior surfaces, said notches being aligned opposite said slots.

26. The holder of claim 23, said means for retaining divider panels in said holder comprising plural rectangular slots in said floor in two lengthwise parallel rows.

27. The holder of claim 23, said means for retaining divider panels in said holder comprising:

(a) plural rectangular horizontal slots in said floor in two lengthwise parallel rows comprising plural pairs of said slots; and (b) plural elongated vertical panel notches disposed in said side wall interior surfaces, said notches being aligned with said pairs of said slots.

28. The holder of claim 6, wherein said shoulders have side edges and wherein said arms have top edges coextensive with said top edges of said side walls and bottom edges coextensive with said side edges of said shoulders.

29. The holder of claim 6, wherein said shoulders have side edges and wherein said arms have top edges coextensive with said top edges of said side walls and bottom edges coextensive with said side edges of said shoulders.

30. The holder of claim 19, wherein said shoulders have side edges and wherein said arms have top edges coextensive with said top edges of said side walls and bottom edges coextensive with said side edges of said shoulders.

31. The holder of claim 20, wherein said shoulders have side edges and wherein said arms have top edges coextensive with said top edges of said side walls and bottom edges coextensive with said side edges of said shoulders.

* * * * *